US006335098B1

(12) United States Patent
Kutzner et al.

(10) Patent No.: US 6,335,098 B1
(45) Date of Patent: Jan. 1, 2002

(54) ROTARY PRESS DOCTOR

(75) Inventors: Willi Albert Peter Kutzner; Wolfgang Günther Ruckmann, both of Würzburg; Karl Robert Schäfer, Rimpar; Georg Schneider, Würzburg, all of (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/284,487

(22) PCT Filed: Oct. 17, 1997

(86) PCT No.: PCT/DE97/02395

§ 371 Date: Apr. 23, 1999

§ 102(e) Date: Apr. 23, 1999

(87) PCT Pub. No.: WO98/18625

PCT Pub. Date: May 7, 1998

(30) Foreign Application Priority Data

Oct. 25, 1996 (DE) ..... 196 44 370
Jun. 13, 1997 (DE) ..... 197 25 061

(51) Int. Cl.[7] ..... B41F 31/00; B41F 31/04; B41F 31/20; B41F 3/00; B41F 3/81

(52) U.S. Cl. ..... 428/422; 428/421; 101/328; 101/329; 101/348; 101/349.1; 101/350.1; 101/350.6; 101/363; 101/364; 101/416.1; 101/422

(58) Field of Search ..... 428/421, 422; 101/363, 169, 350.1, 350.6, 349.1, 328, 329, 348, 364, 416.1, 422

(56) References Cited

U.S. PATENT DOCUMENTS

| | | | | |
|---|---|---|---|---|
| 3,615,450 A | * | 10/1971 | Werber | 96/35.1 |
| 4,070,964 A | | 1/1978 | Vertegaal | |
| 5,027,513 A | | 7/1991 | Allison, Jr. | |
| 5,345,866 A | * | 9/1994 | Reder et al. | 101/363 |
| 5,345,867 A | * | 9/1994 | Schneider et al. | 101/363 |

FOREIGN PATENT DOCUMENTS

| | | |
|---|---|---|
| FR | 2707918 A1 | 7/1993 |
| JP | 4249157 | 9/1992 |
| JP | 4296556 | 10/1992 |
| NL | A 9300810 | 5/1993 |

* cited by examiner

*Primary Examiner*—Vivian Chen
(74) *Attorney, Agent, or Firm*—Jones, Tullar & Cooper, PC

(57) ABSTRACT

An ink duct for use with a screen roller which comprises a working doctor blade and a closing doctor blade, wherein the working doctor blade has one or both sides partially or completely coated with an unreleasable coating of a low surface energy substance having a surface energy of 10 to 60 mN/m. This coating prevents disruptive ink deposits from forming on the side of the working doctor blade opposite to the ink retaining portion of the ink duct and reaching the doctored surface of the ink metering roller in an uncontrolled or random manner.

5 Claims, 2 Drawing Sheets

ROTARY PRESS DOCTOR

FIELD OF THE INVENTION

The present invention relates to a doctor blade for an ink unit of a rotary printing press. The doctor blade is at least partially coated with a substance of low surface energy.

DESCRIPTION OF THE PRIOR ART

It is well known to apply ink to rollers and to subsequently strip excess ink off the roller, for example the screen roller of a rotary printing press, by means of a doctor blade. Ink can collect, during operation of the screen roller, on a side of the doctor blade facing away from the ink duct. This ink collection is a problem particularly in connection with inks of high viscosity.

U.S. Pat. No. 4,070,964 discloses a doctor blade coated with Teflon for reducing the friction between the doctor blade and the screen roller.

NL-A-9300810 describes a doctor blade coated with Teflon.

SUMMARY OF THE INVENTION

The object of the present invention is directed to creating a doctor blade for rotary printing presses.

In accordance with the present invention, this object is attained by providing a doctor blade for a rotary printing press in which the doctor blade is at least partially coated with a substance having low surface energy. The doctor blade can be partially or completely coated on one or both sides over a part of its length or its entire length.

The advantages which can be achieved by means of the present invention in particular rest in that interfering ink accumulations are prevented on a side, typically the outside, of the doctor blade, which side faces away from the interior of the ink duct, i.e. the side of the doctor blade facing the ink metering roller. The smallest "ink droplets" leave the exterior of the doctor blade. No increased, interfering ink deposits can occur can create undesired fluctuations in the ink density on the print carriers such as, for example, a sheet or a web.

BRIEF DESCRIPTION OF THE DRAWINGS

Preferred embodiments of the present invention are represented in the drawings and will be described in greater detail in what follows. Show are in.

DESCRIPTION OF THE PREFERRED EMBODIMENTS

Figure 1:
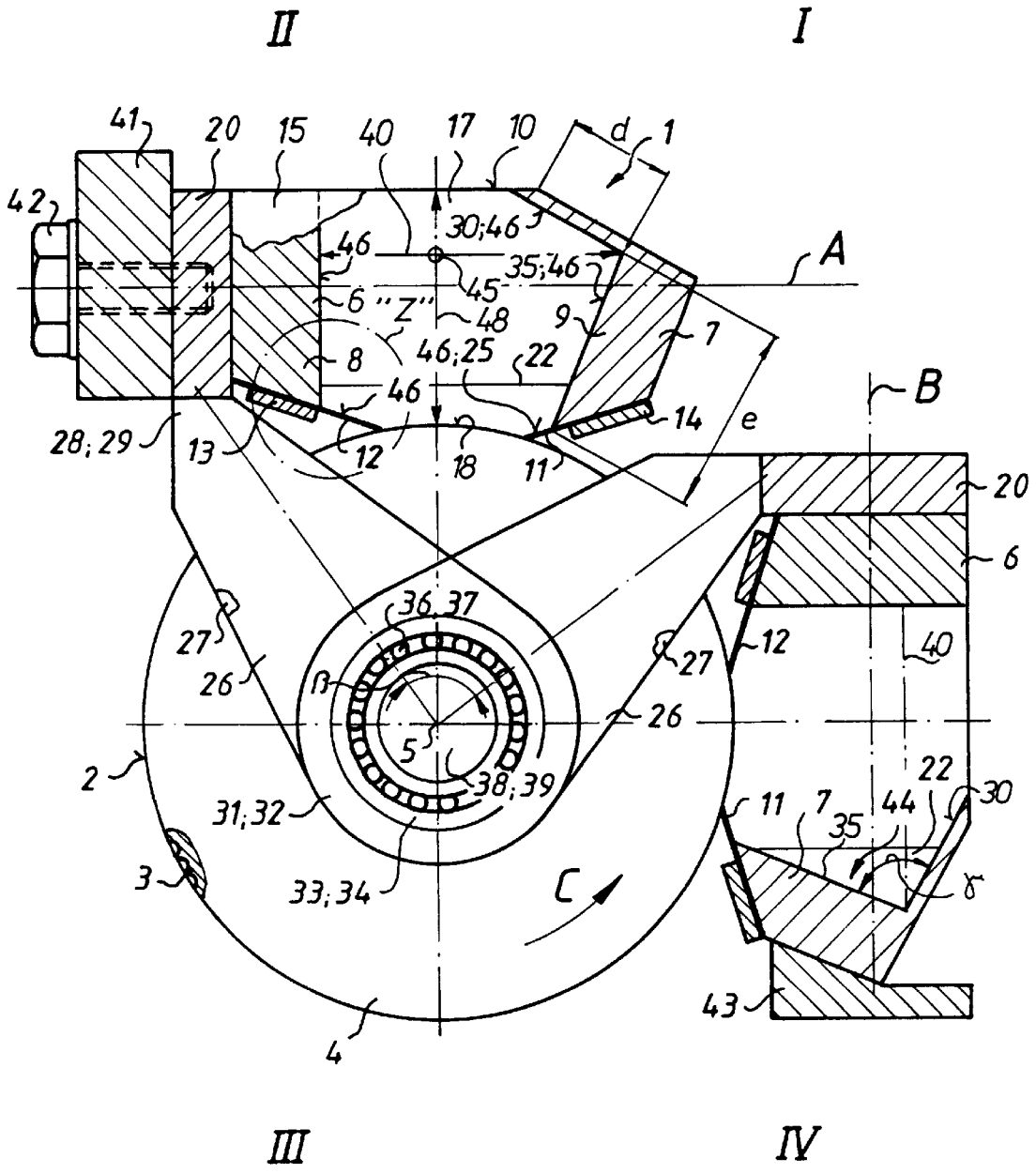
FIG. 1, a schematic representation of a cross section through an ink duct arranged above a screen roller in the working position and the resting position, with doctor blades; and in FIG. 2, an enlarged schematic representation of a detail "Z" in FIG. 1.

A pivotable ink duct 1 with doctor blades in accordance with the present invention, and with a working doctor blade 12 and a closing doctor blade 11, is arranged, in its working position A, on the top of an ink metering roller 4, as is shown in FIG. 1. The ink metering roller 4 has small cups 3 or depressions in its surface 2 and is thus typically identified as a screen roller or a screen surface roller.

Viewed in the production direction C, the closing doctor blade 11 has been positively placed against the ink metering roller 4.

Viewed in the production direction C, the working doctor blade 12 has been negatively placed against the ink metering roller 4 at a negative angle a with respect to a line 16 tangent to the surface 2 of roller 4 at the contact point between the working doctor blade 12 and the roller 4.

The ink duct 1 includes a left lateral wall 6, and a right lateral wall 7, which walls 6 and 7 extend in an axis-parallel direction in respect to the ink metering roller 4 and which are spaced apart from each other. Depending on the intended pivot direction, the left, 6, and/or the right lateral wall 7 is angled toward the interior at a sufficient height and extending over the entire width of the ink duct 1.

Figure 2:
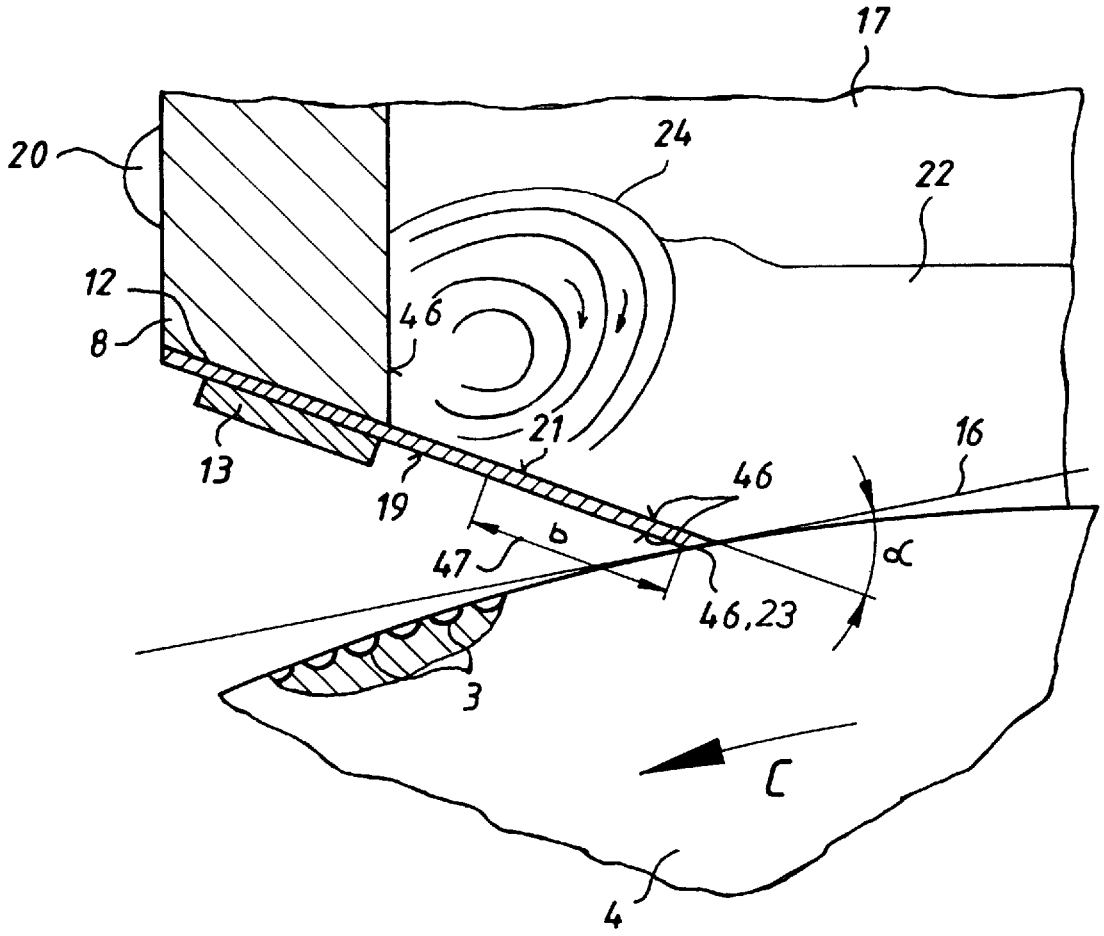

Each of the right/left lateral walls 7, 6 extends downward from its upper edge 10, so that the inside width of the ink duct 1 increases, approximately to half the height of the ink duct 1, and thereafter narrows again in the portion located underneath. By means of this, a channel 44 is formed at the lowest point in the draining position B of the ink duct 1, into which the ink 22 runs and into which the ink 22 is received. The lateral walls 6, 7 extend, when the ink duct 1 is in its working position A, from an upper edge 10 downwardly in the direction toward their lower doctor blade mounting surface 8, 9 facing the ink metering roller 4 On these mounting surfaces 8. 9, doctor blades 11, 12 are held by means of clamping strips 13, or respectively 14. This structure may be seen in both FIGS. 1 and 2.

End walls 15, 17 have been attached to both sides of the ends of the lateral walls 6, 7. The lower side 18 of each end wall 15, 17, facing the ink metering roller 4, has been matched to the contour of the surface 2 of the ink metering roller 4. In its draining position B, the ink duct 1 can be pivoted, for example by the angle $\beta$=70° to 110°, around the axis of rotation 5 of the ink metering roller 4. In this case, the doctor blades 11 and 12 remain in contact with the surface 2 of the ink metering roller 4. The ink duct 1—viewed in its work position A—is open at the top.

The ink duct 1 can be can be fastened on a cross bar 20, for example by means of its lateral wall 6, on the lateral frames of the machine.

In a further preferred embodiment, both ends of the cross bar 20 of the ink duct 1 are fastened on each one of the ends 28, or respectively 29, of a pivot arm 26, or respectively 27. The second ends 31, 32 of the pivot arms 26, 27 are each pivotably seated on a bearing bush 33, 34, fixed on the lateral frames. Via a rolling bearing 36, 37, each bearing bush 33, 34 receives an axle journal 38, 39 of the ink metering roller 4. By means of the steps just described, the ink duct 1 can be pivoted around the axis of rotation 5 of the ink metering roller 4.

In its top, or respectively work position A, the ink duct 1 is moved directly or indirectly into contact against a stop 41 fixed in place on the lateral frames by means of the cross bar 20 fastened on the pivot arms 26, 27, and is locked or fixed in place against stop 41 by means of screws 42. After unlocking, the horizontal ink duct 1 can be laterally pivoted from its work position A on the top of the ink metering roll 4 into a draining position B. In the process, the doctor blades 11 and 12 remain in contact with the circumferential surface 2 of the ink metering roller 4. The pivot angle $\beta$ of the ink duct 1 can lie between 70 and 110°. The pivot movement of the ink duct downward is limited, for example, by a stop 43 fixed in place on the lateral frame. The right lateral wall 7 of the ink duct 1 then rests against stop 43 and is held by it, or respectively is locked to it.

In the process, the ink 22 is collected in a channel 44, open at the top, of the lateral wall 7, which now is in a horizontal position, as shown in FIG. 1.

The ink duct 1 can be embodied to be easily removable, preferably from the press, in the horizontal draining position B, i.e. it can be releasable from the cross bar 20. For this purpose, the left lateral wall 6, for example, can be embodied to be guided by means of a linear guide, not specifically shown, in the cross bar 20 and can be fixed in place.

When the ink duct 1 has been removed from the press, the ink duct 1, as well as the ink metering roller 4, can be easily cleaned.

The achievement of pivoting of the ink duct 1 is not limited to the above described means. It is also possible to pivot the ink duct 1 from the position A to the position B and back by other mechanical means.

For example, the front walls 15, 17 could each be provided with stud bolts, wherein the stud bolts are guided in curved guides fixed on the lateral frames.

The ink metering elements 11, 12, for example ink blades, ink blade lamellas, doctor blades, and the like can be arranged and fastened on the underside of the ink duct 1, as previously discussed. The doctor blades 11 and 12 are used as working doctor blades 12 and as closing doctor blades 11. When using working doctor blades 12, and closing doctor blades 11, at least the working doctor blade 12 is coated with a substance 46 of low surface energy on a first, outer surface 19 and/or on a second inner surface 21 as seen most clearly in FIG. 2. Such substances for example are PTFE, or metal-free amorphous carbon coatings "a-C:H", also called "DLC" coatings or diamond-like carbon coatings. These amorphous carbon coatings consist of a highly cross-linked carbon network, on which hydrogen has been deposited. The surface energy of the DLC coatings, and thereby the wetting behavior, the hardness and the wear, can be selectively affected by a modification of the network structure of fluorine (F), silicon (Si), oxygen (O) and nitrogen (N) and the percental fractions.

Besides PTFE, it is also possible to use DCL+fluorine (F-DLC), DLC+silicon (Si-DLC), DLC+oxygen (O-DLC) and DLC+nitrogen (N-DLC) and DLC+boron (B-DLC).

In accordance with a further preferred embodiment, the coating substance 46 of low surface energy can consist of hydrocarbon polymers, in particular of poly (propylene), or poly (styrene), and copolymers.

Furthermore the substance 46 of low surface energy can consist of styrene polymers, in particular poly (styrene-stat-2,2,3,3-tetrafluoropropyl methacrylate).

Furthermore, the substance 46 of low surface energy can consist of halogen hydrocarbon polymers, in particular poly (chlorotrifluoroethylene), or poly(chlorotrifluoroethylene-stat-tetrafluoroethylene), or poly(hexafluoropropylene), or poly(tetrafluoroethylene), or poly(tetrafluoroethylene-stat-ethylene), or poly(trifluoroethylene).

Furthermore, the coating substance 46 of low surface energy can consist of vinyl polymers, in particular of poly ((heptafluoroiso-propoxy)ethylene)methyl), or poly(1-(heptafluoroisopropoxy)methyl).

Furthermore, the substance 46 of low surface energy can consist of fluoridated acrylic polymers, in particular of poly((1-chlorodifluoromethyl)fluoromethyl acrylate), or poly(di(chloro-difluoromethyl)fluoromethyl acrylate), or poly(1,1-dihydrohepta-fluorobutyl acrylate), or poly(1,1,-dihydropentafluoroisopropyl acrylate), or poly(1,1,-dihydropentadecafluorooctyl) acrylate, or poly (heptafluoroisopropyl acrylate), or poly(5-(heptafluoroiso-propoxy)pentyl acrylate), or poly(11-(heptafluoroisopropoxy) undecyl acrylate), or poly(2-(heptafluropropoxy)ethyl acrylate), or poly (nonafluoroisbutyl acrylate).

Furthermore, the substance 46 of low surface energy can consist of non-fluoridated methacrylic polymers, in particular of poly(benzyl methacrylate), or poly(n-butyl methacrylate), or poly(isobutyl methacrylate), or poly (t-butyl methacrylate) or poly(t-butylaminoethyl methacrylate), or poly(dodecyl methacrylate), or poly(lauryl methacrylate), or poly(ethyl methacrylate), or poly(2-ethylhexyl methacrylate), or poly(n-hexyl methacrylate), or poly(dimethylaminoethyl methacrylate), or poly (hydroxyethyl methacrylate), or poly(lauryl methacrylate), or poly(phenyl methacrylate), or poly(n-propyl methacrylate), or poly(stearyl methacrylate).

Furthermore, the substance 46 of low surface energy can consist of fluoridated methacrylic polymers, in particular of poly(1,1-dihydropentadecafluorooctyl methacrylate), or poly(heptafluoroisopropyl methacrylate), or poly (heptadecafluoro-octyl methacrylate), or poly(1-hydrotetrafluoroethyl methacrylate), or poly(1,1-dihydrotetrafluoropropyl methacrylate), or poly(1-hydrohexafluoroisopropyl methacrylate), or poly(t-nona-fluorobutyl methacrylate), or poly(styrene-stat-2,2,3,3,-tetrafluoropropyl methacrylate).

Furthermore, the substance 46 of low surface energy can consist of polyether heteropolymers, for example of poly (oxy-ethylene-stat-oxypropylene)-block-poly (oxydimethylsilylene)-block-poly(oxyethylene-stat-oxypropylene).

Furthermore, the substance 46 of low surface energy can consist of polyimines, in particular of poly((benzoylimino) ethylene), or poly ((butyrylimino) ethylene), or poly ((dodecanoyl-imino)ethylene), or poly((dodecanoyl-imino) ethylene-stat-(acetyl-imino)trimethylene), or poly ((heptanoylimino)ethylene), or poly ((hexanoylimino) ethylene), or poly(((3-methyl)butyrylimino) ethylene), or poly((pentadecafluorooctadecanoylimino)ethylene), or poly ((pentanoylimino)ethylene).

Furthermore, the substance 46 of low surface energy can consist of polyurethanes, in particular of poly (methylenediphenyl-diisocyanate-alt-(butanediol poly (oxytetramethylene)diol), or poly(hexamethylene diisocyanate-alt-triethylene glycol), or poly (4-methyl-1,3-phenylene diisocyanate-alt-tripropylene glycol).

The substance 46 can also consist of polysiloxanes, in particular poly(oxydimethyl-silylene), alpha, omega-difunctional $R—(Si(CH_3)_2—O)_n—Si(CH_3)_2—R$, or poly (oxydimethylsilylene) block copolymers.

Also, the substance 46 can consist of hydrolized and condensed organosilanes, in particular of 3-(1,1,-dihydroper-fluorooctoxy) propyltriethoxysilane, $CF_3(CF_2)_6CH_2O(CH_2O(Ch_2)_3Si(OC_2H_5)_3$, or gamma-perfluoroisopropoxypropyltrimethoxysilane, $(CF_3)_2CFO(CH_2)_3Si(OCH_3)_3$.

Finally, it is also possible to use the above mentioned polymers individually or in a mixture of two and several of the said polymers as the coating substance 46.

Coating with the substances 46 takes place with a coating thickness which, for example, lies between 0.5 and 10 $\mu$May.

At least the first or outer surface 19 of the working doctor blade 12 is coated, on the surface facing the ink metering roller 4, which can be embodied as a screen roller 4 or as a roller 4, with an oleophilic material. This outer surface 19 can be coated completely or only partially with the coating substances 46. Such a partial coating of the coating substance 46 can be applied in the area 47 close to the roller, for example. This partial coated area 47 starts at the squeeze-off surface or contact surface 23 between roller 4 and doctor blade 12 and extends over the entire length of the working doctor blade 12 and has a width b, for example of 0.5 to 10 mm. The second or inner surface 21 of the working doctor blade 12 facing the interior of the ink duct 1—i.e. the interior chamber of the ink duct or the ink retaining space can also be coated as described above.

The closing doctor blade 11 can be coated in the same way as the working doctor blade 12.

The squeeze-off surface 23, which is the portion of the doctor blade 12 in contact with the surface of the ink metering roller 4, can also be coated with the substances 46 of low surface energy.

Coating the doctor blades 11, 12 in the manner described above is also reasonable when employing inks of any arbitrary viscosity.

It is, of course, also possible to place the doctor blades 11, 12 at the same angle against the ink metering roller 4.

One of the lateral walls 7, 6 is preferably angled in such a way that an opening angle y of approximately 90° is opened between the upper partial lateral wall 30 and the lower partial lateral wall 35. In this case, the width d of the upper partial lateral wall 30 can be equal to the width e of the lower partial lateral wall 35. However, width d can also be greater than width e and vice versa. A longitudinal axis of the ink duct 1 is identified by 45 and a vertical axis of the ink duct 1 by 48.

Preferably the ink duct 1 is pivoted, in relation to a right-angled coordinate system with the origin on the axis of rotation 5 of the ink metering roller 4, from its work position A located in the I. or II. quadrants or in the I. and II. quadrants, in relation to the position of the doctor blades 11, 12 on the ink metering roller 4 into a draining position B located in the I. and IV. quadrants, as seen in FIG. 1 or in the II. and III. quadrants in relation to the position of the doctor blades 11, 12. Thus, the ink duct 1 is pivoted out of a position, wherein the transverse axis 40 of the ink duct 1 extends horizontally or approximately horizontally, in such a way, that at the end of pivoting the transverse axis 40 of the ink duct 1 extends vertically or approximately vertically.

It is moreover possible to embody the ink duct 1 closed on the top, i.e. on its upper edge 10.

The substance 46 of low surface energy used for coating the doctor blade 11, 12 has a surface energy or surface tension in the range of between 10 and 60 mN/m. The doctor blade 11, 12 which is the support for the substance 46, is made of metal.

While a preferred embodiment of a rotary press doctor in accordance with the present invention has been set forth fully and completely hereinabove, it will be apparent to one of skill in the art that a number of changes, for example in the type of press being used, the specific type of roller used, and the like can be made without departing from the true spirit and scope of the present invention which is accordingly to be limited only by the following claims.

What is claimed is:

1. An ink duct adapted for use with a screen roller of an ink unit, said ink duct comprising:

a working doctor blade and a closing doctor blade in said ink duct, said working doctor blade engaging a surface of the screen roller along a contact surface of said working doctor blade;

a supply of ink in said ink duct for application to the screen roller;

a working doctor blade inner surface facing said supply of ink to be applied to the screen roller;

a working doctor blade outer surface facing the screen roller and facing away from said supply of ink; and a low surface energy coating substance on said working doctor blade outer surface and on said working doctor blade contact surface out of contact with said supply of ink in said ink duct, said low surface energy coating having a surface energy between 10 and 60 mN/m, said low surface energy coating on said working doctor blade outer surface extending from said contact surface in an area close to the surface of the screen roller, said low surface energy coating preventing droplets of said ink from said supply of ink from accumulating on said outer surface of said working doctor blade adjacent said contact surface.

2. The ink duct in accordance with claim 1 characterized in that said substance consists of a polymer.

3. The ink duct in accordance with claim 2 characterized in that said substance consists of polytetra-fluorethylene (PTFE).

4. The ink duct in accordance with claim 1 characterized in that said substance is applied at a coating thickness of 0.5 to 10 $\mu$m.

5. The ink duct in accordance with claim 1 wherein said ink duct is arranged on top of the screen roller.

* * * * *